US007150665B1

(12) United States Patent
Soreide et al.

(10) Patent No.: US 7,150,665 B1
(45) Date of Patent: Dec. 19, 2006

(54) APPARATUS AND METHOD FOR SIMULTANEOUSLY FLUSHING MULTIPLE OUTBOARD BOAT MOTORS

(76) Inventors: Lars Soreide, 5180 W. Atlantic Blvd., Delray Beach, FL (US) 33484; Jordan Soblick, 6436 Dorsey Ct., Delray Beach, FL (US) 33484

( * ) Notice: Subject to any disclaimer, the term of this patent is extended or adjusted under 35 U.S.C. 154(b) by 0 days.

(21) Appl. No.: 11/215,476

(22) Filed: Aug. 30, 2005

(51) Int. Cl.
*B63B 13/00* (2006.01)

(52) U.S. Cl. ..... 440/88 N

(58) Field of Classification Search ..... 440/88 C, 440/88 N, 88 R, 113
See application file for complete search history.

(56) References Cited

U.S. PATENT DOCUMENTS 4,729,393 A * 3/1988 Ferguson ..... 440/88 R
4,842,002 A * 6/1989 Ferguson ..... 440/88 R
5,071,377 A 12/1991 Saunders
5,111,762 A 5/1992 Frangiamore
5,123,369 A 6/1992 Gross
5,131,421 A 7/1992 Hofbauer
5,295,880 A 3/1994 Parker
5,350,329 A * 9/1994 Haman ..... 440/88 R
5,362,266 A 11/1994 Brogdon
5,393,252 A 2/1995 Brogdon
5,441,431 A 8/1995 Brogdon
5,549,494 A 8/1996 Fosmer
5,584,735 A * 12/1996 McMath ..... 440/88 R
5,628,285 A * 5/1997 Logan et al. ..... 440/88 N
5,664,526 A * 9/1997 Logan et al. ..... 440/88 N
5,830,023 A 11/1998 Brogdon
6,089,934 A 7/2000 Biggs et al.
6,579,136 B1 6/2003 Hahn et al.
6,695,660 B1 2/2004 Ellis
6,776,677 B1 * 8/2004 Knapp, Jr. ..... 440/88 N
2005/0081927 A1 4/2005 Akhavein

* cited by examiner

*Primary Examiner*—Lars A. Olson
(74) *Attorney, Agent, or Firm*—Gold & Rizvi, P.A.; Glenn E. Gold; H. John Rizvi

(57) ABSTRACT

Apparatus for simultaneously flushing multiple outboard boat motors, or for simultaneously flushing a boat motor and hosing down a boat, includes a water flow manifold having a single input conduit, which receives water from a single water source, and communicates the water to at least two output conduits of the manifold. A water flow control means interposed between the input conduit and the output conduits controls the relative flow of water to the output conduits. Flexible tubing attached to and extending from the output conduits communicates the relative water flow to a pair of tubing adapters, each having one end attached to the flexible tubing and an opposite end either attached to a motor flush port or, alternatively, to a conventional water hose nozzle.

9 Claims, 3 Drawing Sheets

APPARATUS AND METHOD FOR SIMULTANEOUSLY FLUSHING MULTIPLE OUTBOARD BOAT MOTORS

BACKGROUND OF THE INVENTION

1. Field of the Invention

The present invention generally relates to fresh water flushing systems for boats and, more particularly, to an apparatus and method for simultaneously flushing two or more outboard boat engines with fresh water.

2. Description of the Prior Art

By design, virtually every outboard drive unit in the marine industry seems to have an aversion to residing in the very water it's intended to operate in. It is critical to keep the lower unit of outboard motors free and clear of the corrosive effects of extended submerged periods and avoid the accumulation of marine growth that occurs in almost every body of water. Consequently, an important aspect of routine boat maintenance is the fresh water flushing of outboard motors, particularly after use in salt water. A variety of fresh water flushing apparatus have been developed for directing a flow of fresh water into the intake of the lower unit of an outboard boat engine. For example, most boaters are familiar with the so-called "ear muff" flushing systems, in which twin rubber suction cups with at least one carrying a hose bib, are held in place by the open ends of a U-shaped steel rod. Most docks and other launch facilities provide pressure water for this purpose, as well as for enabling general cleaning of the boat body after removal of the boat from the water.

A significant limitation of existing fresh water flushing systems is that they are designed for the flushing of only a single motor at a time. Conventionally, a boater will attach a flushing apparatus to a single hose line extending from a water source, and then flush a single boat motor at a time. For boaters having two or more outboard engines, this limitation results in added post boating maintenance time.

Accordingly, it would be highly desirable to provide a flushing apparatus enabling the use of a single water source to flush two or more engines simultaneously. Furthermore, it would be desirable to provide such an apparatus having the flexibility to enable the use of a single water source to simultaneously flush one engine and clean the boat hull and accessories.

SUMMARY OF THE INVENTION

The present invention is directed to a fresh water flushing apparatus for outboard boat engines, which enables the use of a single water source to simultaneously flush two or more boat motors having integral flush ports. Alternatively, the apparatus can be used to simultaneously flush a single boat motor having a flush port and clean the boat exterior and accessories.

In one general aspect of the invention, apparatus for simultaneously flushing multiple outboard boat motors, each having a motor flush port, from a single water source, comprises: a water flow manifold having a single input conduit in communication with at least two output conduits; a water flow control means interposed between the input conduit and the output conduits for controlling the relative flow of water through the output conduits; at least two lengths of flexible tubing each having opposite proximal and distal ends, a proximal end of each flexible tubing length secured to one of one of the output conduits such that the flexible tubing length is in communication with the output conduit; and at least two tubing adapters each having a first end configured for sealing engagement with a distal end of each flexible tubing length and an second opposite end configured for sealing engagement with a motor flush port of the outboard motor.

In another aspect of the invention, the apparatus further includes means for communicating water from the single water source to the single input conduit of the water flow manifold. For instance, the water communication means may comprise a length of flexible hose having a first end adapted for attachment to the input conduit of the water flow manifold and a second end adapted for attachment to the single water source.

In a further aspect of the invention, the apparatus includes a flow control means, which may include a display portion for enabling visual determination of the relative water flow through the output conduits.

In still another aspect of the invention, the tubing adapters have one end configured for threading engagement with the boat motor flush port, and an opposite barbed male end sized for frictional sealing engagement with the distal end of one of the lengths of flexible tubing attached to and extending from the manifold output conduits.

In yet a further aspect of the invention, the tubing adapter includes a gripping portion interposed between the barbed and threaded ends, to facilitate manual rotation of the tubing adapter.

In still yet a further aspect of the invention, the apparatus is configured to simultaneously direct the flow of water from a single water source to a flush port of a boat outboard engine and to a conventional water hose nozzle, thereby enabling the a boater to simultaneously flush an outboard boat engine and clean the boat body and accessories.

BRIEF DESCRIPTION OF THE DRAWINGS

The invention will be further understood, by way of example, with reference to the accompanying drawings, in which.

DETAILED DESCRIPTION OF THE PREFERRED EMBODIMENTS

As shown in the accompanying drawing Figures, the present invention is generally directed to an apparatus for simultaneously flushing multiple, and typically two, outboard boat engines with fresh water from a single source of fresh water. Fresh water sources are typically available at most boat docks and launch facilities. In an alternative embodiment of the invention, the apparatus is adapted for use simultaneously flushing a single outboard boat engine and hosing down the boat body and accessories using a pressurized water hose nozzle. In the accompanying drawing Figures, the apparatus is shown adapted for diverting a single water flow into two separate water flows. As will be apparent to those skilled in the art, alternate manifold structures, for example, diverting a single flow of water into three or more water flows, are considered to be within the scope of the present invention.

Figure 1:
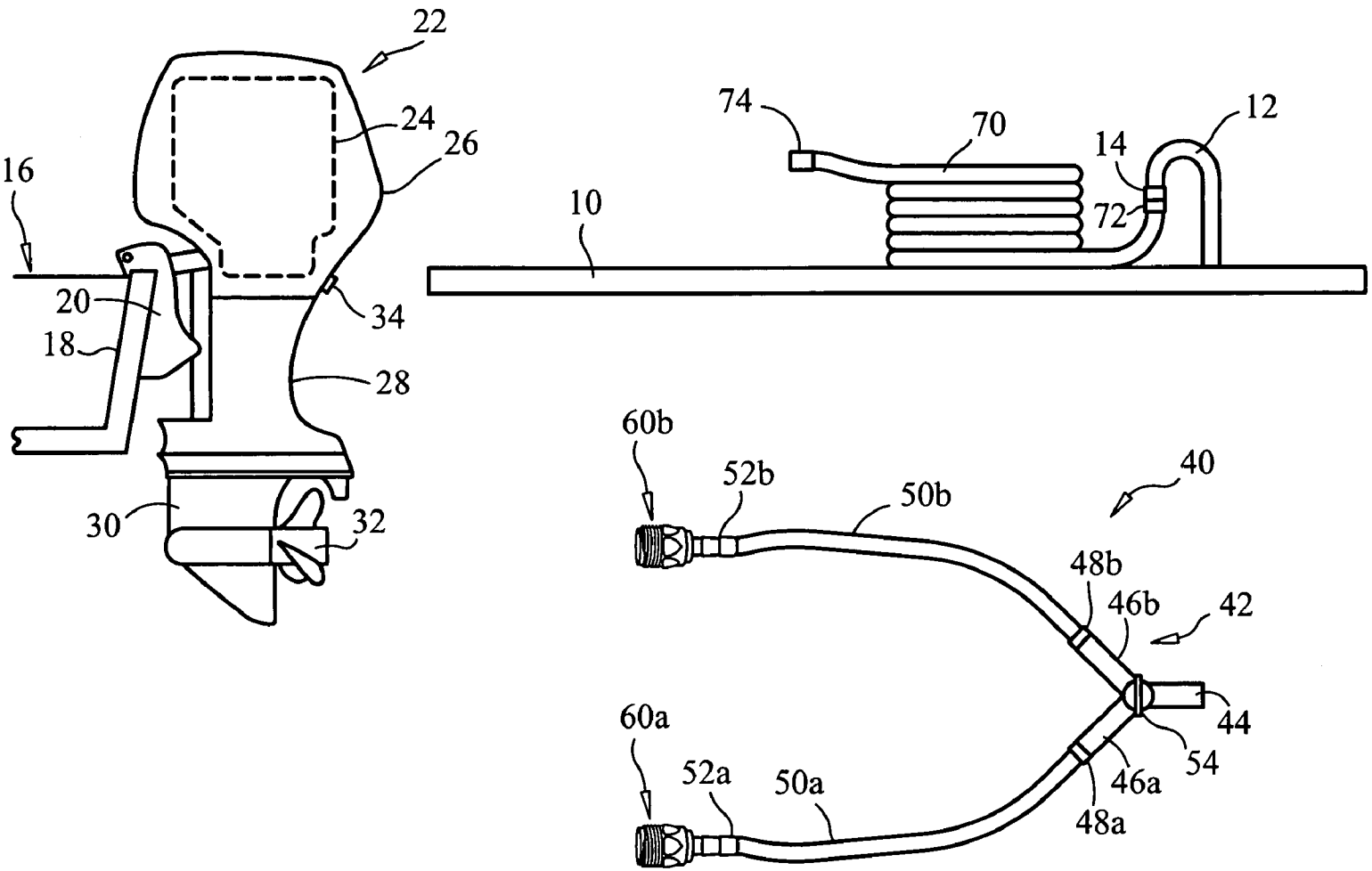
FIG. 1 is a schematic illustration of the fresh water flushing apparatus of the present invention.
Figure 2:
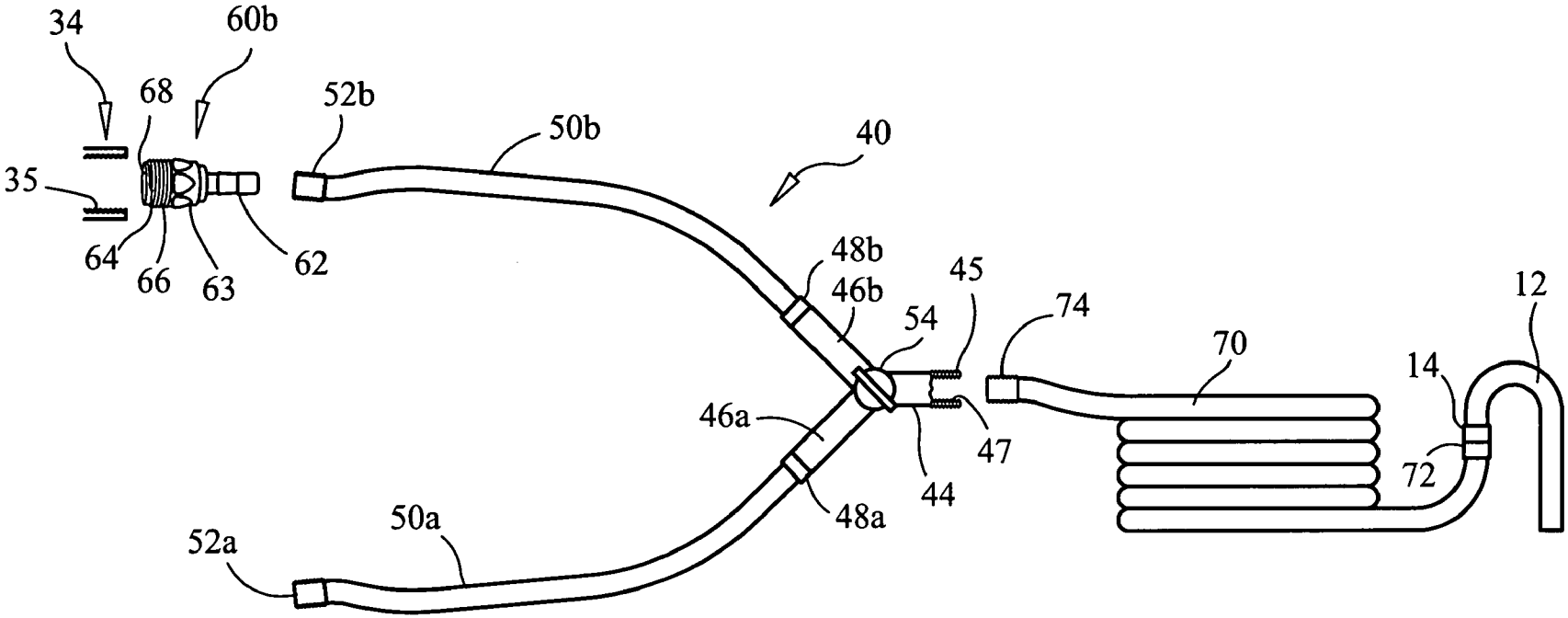
FIG. 2 is an exploded front view, in partial section, of the fresh water flushing apparatus of the present invention.

Referring initially to FIG. 1, the apparatus of the present invention, shown generally as reference numeral 40, communicates water flow from a single water source 12, for example, at a ramp facility or dock 10, to an outboard boat motor 22. Conventionally, one or more outboard boat motors 22 are mounted on a transom 18 on the body of a boat 16 by a clamp bracket 20. A drive housing 28, which occupies the center of the motor, is joined to the clamp bracket 20 by a swivel shaft (not shown). Located above the drive housing is an engine cover 26, in which an engine 24 is stored. A gear case 30 is provided in the lower part of the drive shaft housing, and a shaft (not shown) in the back of the gear case supports a propeller 32. Moreover, the propeller is rotationally driven by a drive shaft (not shown) that extends vertically downward from the engine. On most modern outboard boat motors, a fresh water flush port 34 is typically provided along the rear side slightly above the drive housing. However, the flush port 34 can be located elsewhere, depending upon the engine make and model. Referring briefly to FIG. 2, the flush port 34 typically has an internally threaded 35 female configuration. However, as described in more detail hereinbelow, the apparatus of the present invention is easily adaptable for use with outboard motors having alternate flush port structures, including, for example, externally threaded male flush port structures.

The apparatus of the present invention incorporates a manifold structure, shown generally as reference numeral 42, which may be Y-shaped or T-shaped. The manifold 42 includes an inlet port 44 in communication with a pair of outlet ports, 46*a* and 46*b*. The manifold 42 also includes flow control means 54, such as a conventional flow control valve, for controlling the flow of water through the outlet ports 46*a*, 46*b* of the manifold. Flow control valves are well know to those skilled in the art and a more detailed description of their structure and operation is not necessary to understand and practice the present invention. Although not shown in the accompanying Figures, the flow control valve may include a flow measurement display portion, or a similar visual indicator, to enable a user to more precisely determine the relative water flow through the output conduits or ports 46*a*, 46*b*. Two lengths of fluid transfer lines, preferably flexible tubing 50*a*, 50*b*, connect the output ports, 46*a* and 46*b*, with a corresponding pair of tubing adapters, 60*a* and 60*b*, respectively. The lengths of flexible tubing 50*a*, 50*b* may be constructed from any of a number of well known commercially available plastic and/or rubber tubing or hose materials capable of conveying water flows having typical working pressures, within a range generally produced from conventional home or dockside water sources, without rupturing; including, for example, polyvinylchloride nylon braided hose, 2-ply reinforced rubber/vinyl composite hoses, and the like.

Proximal ends of the lengths of flexible tubing, 50*a* and 50*b*, are attached to, and extend from, output ports 46*a* and 46*b*, respectively. The output ports 46*a* and 46*b* may be inserted into the respective proximal ends of the flexible tubing, 50*a* and 50*b*, and further secured by a first pair of hose clamps, 48*a* and 48*b*, thereby providing a seal to guard against water leakage. Other means of attachment may be employed, however, they should provide fluid communication of water from the output ports, 46*a* and 46*b*, to the respective lengths of flexible tubing, 50*a* and 50*b*, as well as an adequate seal to preclude leakage of water under pressure. In lieu of using clamps or other structural components, the lengths of flexible tubing, 50*a* and 50*b*, may be attached using a chemical adhesive, or integrally molded to the respective output ports, 46*a* and 46*b*, to form a permanent sealing attachment.

Figure 3:
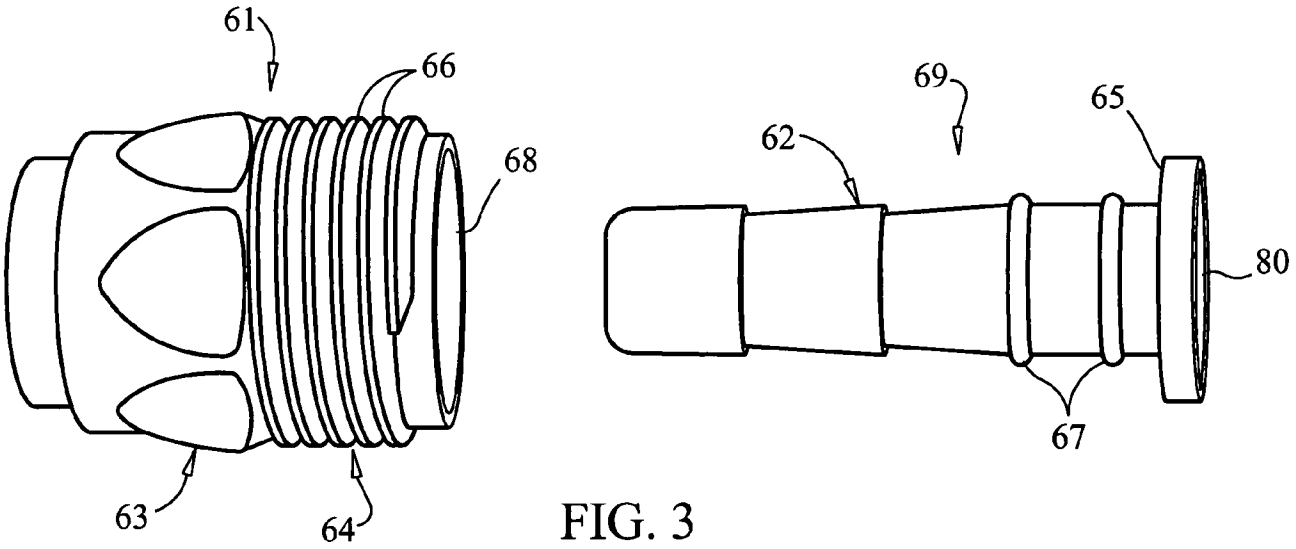
FIG. 3 is a perspective exploded view of the tubing adapter portion of the fresh water flushing apparatus of the present invention.
Figure 4:
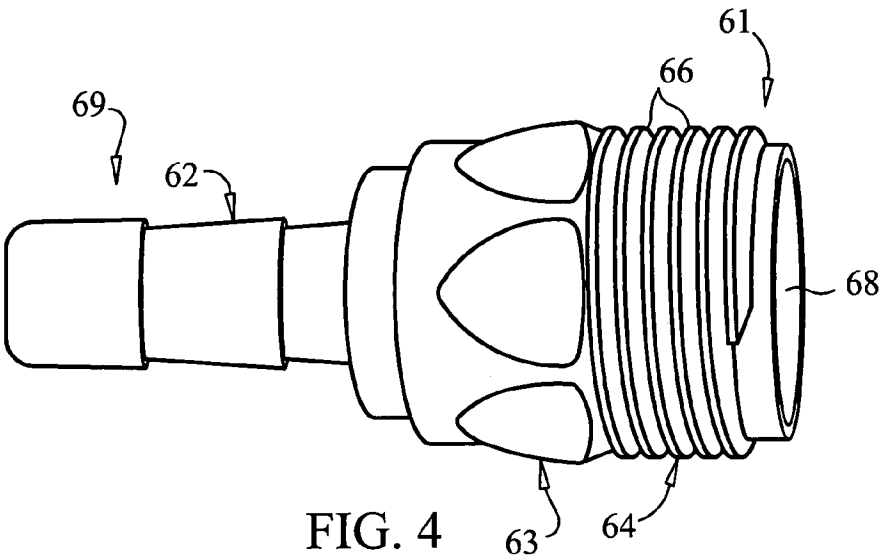
FIG. 4 is a perspective view of the tubing adapter of FIG. 3 shown assembled.

Referring now to FIGS. 1–4, at their distal ends, the lengths of flexible tubing, 50*a* and 50*b*, are attached to a pair of tubing adapters, 60*a* and 60*b*. As described in more detail below, each tubing adapter 60*a*, 60*b* has an end inserted into a distal end of one of the lengths of tubing, 50*a* and 50*b*, and further secured by a second pair of hose clamps, 52*a* and 52*b*, respectively. As best shown in FIGS. 3 and 4, the tubing adapters, 60*a* and 60*b*, are generally comprised of individual molded plastic flush port connector 61 and flexible tubing connector 69 pieces which, when fully assembled, have a structure uniquely configured to fluidly couple the flexible tubing lengths, 50*a* and 50*b*, to flush ports 34 on the boat outboard engines 22. Other means of attachment may be employed, however, they should provide fluid communication of water between the flexible tubing lengths, 50*a* and 50*b*, and the barbed male structure 62 of the tubing connector pieces 69, as well as an adequate seal to preclude leakage of water under pressure. In lieu of using clamps or other structural components, the lengths of flexible tubing, 50*a* and 50*b*, may be attached using a chemical adhesive, or they may be integrally molded to the barbed male structure 69 of the respective tubing connectors 69. Accordingly, the manifold 42, flexible tubing lengths, 50*a* and 50*b*, and tubing adapters, 60*a* and 60*b*, may all be molded to form a single, unitary apparatus. The unitary molded structure provides the benefit of facilitating use of the outboard boat motor flushing apparatus without requiring any assembly prior to operation.

The flexible tubing attachment portion 69 is generally comprised of a cylindrical barbed male structure 62 extending from an increased diameter annular base 65. The barbed male structure 62 is sized and shaped for snug insertion into a distal end of one of the lengths of flexible tubing 50*a*, 50*b*. A second pair of hose clamps 52*a*, 52*b* are provided to ensure sealing engagement of the tubing over the barbed end 62. Alternatively, as described hereinabove, permanent sealing engagement may be achieved using a chemical adhesive or direct molding process. A central aperture 80 extends completely through flexible tubing attachment portion 69. Furthermore, one or more resilient sealing members 67, such as bushings, grommets, gaskets and the like, may be provided along the length of barbed male structure 62. As further described below, the resilient sealing members 67 function to provide sealing engagement between flush port connector piece 64 and flexible tubing connector piece 69.

The flush port connector piece 61 has an end 64 with an externally threaded surface 66, for threading engagement with complementary boat motor internal flush port threads 35. An opposite gripping end 63, which may have an increased diameter and/or a gripping surface configuration, is provided to facilitate rotation of the tubing adapters 60*a*, 60*b* during threading engagement with the flush port 34. As will be apparent to those skilled in the art, alternative configurations of the flush port connector piece 61 may be provided depending, for instance, upon the structure of the flush port 34 of the particular outboard boat engine. For example, where the flush port is provided having an externally threaded configuration, the first end 64 of tubing adapters portion 61 may be provided having internal threads. An interior surface 68 defines a central aperture extending through flush port connector piece 61. Although not shown in the accompanying drawings, an inwardly protruding interior rib is provided approximately midway through flush port connector piece 61. The interior rib provides a ledge surface against which an upper surface of base 65 of flexible tubing connector piece 69 abuts when flush port connector piece 61 is inserted therein during assembly. A resilient cylindrical annular member (not shown) is provided within the gripping end of flush port connector piece 61, which frictionally engages the outer surface of barbed male structure 62 when flush port connector piece 61 and flexible tubing connector piece 69 are fully assembled.

As best shown in FIG. 2, the input port 44 of manifold 42 is preferably provided having both external threads 45 and internal threads 47, to facilitate threading attachment of a hose connector 74, at a distal end of a primary hose 70, having either internal or external threads. Alternatively, the input port 44 may be provided having either internal or external threads. At a proximal end, primary hose 70 is preferably provided having a hose connector 72 configured for attachment to an end 14 of a primary water source 12. Alternatively, as previously described hereinabove with regard to attachment of flexible hosing lengths 52*a* and 52*b*, hose 70 may have its distal end directly permanently attached to the input port 44, for example, using a chemical adhesive or an integral molding process, in lieu of providing hose connector 74.

Where the apparatus is to be used to simultaneously flush two outboard boat motors, tubing adapters 60*a* and 60*b* are initially snugly threaded into corresponding motor flush ports 34. Distal ends of flexible tubing lengths 50*a* and 50*b* are securely attached to the tubing adapters, 60*a* and 60*b*, by snugly inserting barbed ends 62 into the respective distal ends. Hose clamps, 52*a* and 52*b*, previously provided around flexible tubing lengths, 50*a* and 50*b*, are tightened to ensure sealing engagement of the distal ends of the flexible tubing lengths, 50*a* and 50*b*, to the barbed ends 62. In similar fashion, proximal ends of the lengths of flexible tubing, 50*a* and 50*b*, are snugly attached to the respective output ports, 46*a* and 46*b*, and further secured using respective hose clamps 48*a* and 48*b*. A hose connector 74 at the distal end of flexible hose 70 is attached to input port 44, and an opposite hose connector 72 at the proximal end of flexible hose 70 is secured to an attachment end 14 of a water spigot 12 or the like. Alternatively, where the flexible tubing lengths, 52*a* and 52*b*, are provided permanently attached to the respective manifold output ports, 46*a* and 46*b*, and the male ends 62 of the respective tubing adapters, 60*a* and 60*b*, set-up merely requires threading attachment of the tubing adapters 60*a* and 60*b* into corresponding motor flush ports 34, and attachment of hose connector 72 to attachment end 14 of spigot 12.

In use, a pressurized fresh water flow from spigot 12 is communicated through flexible hose 70 into and through manifold input port 44, where it is diverted into output ports 46*a* and 46*b*, and then communicated through flexible tubing lengths 50*a* and 50*b*, into and through respective tubing adapters 60*a* and 60*b*, and then into the flush ports 34 of the respective outboard boat motors 22. Alternatively, input port 44 may be connected directly to the attachment end 14 of spigot 12.

In an alternate embodiment of the present invention, one of the tubing adapters 60*a*, 60*b* is coupled to the flush port 34 of a single boat motor 22, while the other one of the tubing adapters 60*a*, 60*b* is attached to a water hose nozzle (not shown). Preferably, in this embodiment of the invention, an additional length of water hosing (not shown) is provided having a proximal end attached to tubing adapter end 64, and an opposite distal end attached to the water hose nozzle. In that case, a user of the apparatus 40 can simultaneously flush one boat motor while utilizing the water hose nozzle to clean the boat body, accessories and any other non-motor structure or component.

Having described the preferred embodiment and certain variations of the present invention, it will be recognized and understood that various modifications can be made in the invention, and the appended claims are intended to cover all such modifications that may fall within the spirit and scope of the invention.

What is claimed is:

1. Apparatus for simultaneously flushing a single outboard boat motor having a motor flush port and washing the exterior of a boat from a single water source, comprising:

a water flow manifold having a single input conduit in communication with at least two output conduits;

a water flow control means interposed between said input conduit and said at least two output conduits, said water flow control means controlling the relative flow of water through said at least two output conduits;

at least two lengths of flexible tubing each having proximal and distal ends, the proximal end of each flexible tubing length secured to one of said at least two output conduits such that the flexible tubing length is in communication with the output conduit; and a first tubing adapter having a first end configured for sealing engagement with the distal end of a first one of said flexible tubing lengths and a second opposite end configured for sealing engagement with a motor flush port of said outboard motor;

a second tubing adapter having a first end configured for sealing engagement with the distal end of a second one of said flexible tubing lengths and a second opposite end;

a length of hosing having a first end attached to the second end of said second tubing adapter, and having a second end attached to a water hose spray nozzle.

2. Apparatus as recited in claim 1, further comprising a length of flexible tubing for communicating water from said single water source to the single input conduit of said water flow manifold, said length of flexible tubing having a first end adapted for attachment to the input conduit of said water flow manifold and a second end adapted for attachment to said single water source.

3. Apparatus as recited in claim 1, wherein said water flow manifold further comprises one of a T-shaped manifold and a Y-shaped manifold.

4. Apparatus as recited in claim 1, wherein said water flow control means includes a display portion for enabling visual determination of the relative water flow through said at least two output conduits.

5. Apparatus as recited in claim 1, wherein the first end of each said tubing adapter further comprises a threaded conduit end.

6. Apparatus as recited in claim 5, wherein said threaded conduit end further comprises an externally threaded male coupling configured for threading engagement with a corresponding internally threaded female flush port.

7. Apparatus for simultaneously flushing multiple outboard boat motors, each having flush ports, from a single water source, comprising:

a water flow manifold having a single input conduit in communication with at least two output conduits;

a water flow control means interposed between said input conduit and said at least two output conduits, said water flow control means controlling the relative flow of water through said at least two output conduits and including a display portion for enabling visual determination of the relative water flow through said at least two output conduits;

at least two lengths of flexible tubing each having proximal and distal ends, the proximal end of each flexible tubing length secured to one of said at least two output conduits such that the flexible tubing length is in communication with the output conduit; and at least two tubing adapters, each having a first end configured for sealing engagement with the distal end of each flexible tubing length and a second opposite end configured for sealing engagement with a motor flush port of said outboard motor.

8. Apparatus for simultaneously flushing multiple outboard boat motors, each having flush ports, from a single water source, comprising:

a water flow manifold having a single input conduit in communication with at least two output conduits;

a water flow control means interposed between said input conduit and said at least two output conduits, said water flow control means controlling the relative flow of water through said at least two output conduits;

at least two lengths of flexible tubing each having proximal and distal ends, the proximal end of each flexible tubing length secured to one of said at least two output conduits such that the flexible tubing length is in communication with the output conduit;

at least two tubing adapters, each having a first end configured for sealing engagement with the distal end of each flexible tubing length and a second opposite end configured for sealing engagement with a motor flush port of said outboard motor; and a length of flexible hose having a proximal end attached to a first end of one of said tubing adapters and having a distal end attached to a water hose spray nozzle.

9. Apparatus for simultaneously flushing multiple outboard boat motors, each having flush ports, from a single water source, comprising:

a water flow manifold having a single input conduit in communication with at least two output conduits;

a water flow control means interposed between said input conduit and said at least two output conduits, said water flow control means controlling the relative flow of water through said at least two output conduits;

at least two lengths of flexible tubing each having proximal and distal ends, the proximal end of each flexible tubing length secured to one of said at least two output conduits such that the flexible tubing length is in communication with the output conduit;

at least two tubing adapters, each having a first end configured for sealing engagement with the distal end of each flexible tubing length and a second opposite end configured for sealing engagement with a motor flush port of said outboard motor; and each said tubing adapter further comprising:

a flush port connector piece having a central aperture extending therethrough and a threaded end configured for removable attachment to the flush port of an outboard boat motor, said central aperture having an inwardly protruding rib portion;

a flexible tubing connector piece having a generally cylindrical barbed stem extending from an annular base portion, said tubing connector piece having a central aperture extending therethrough;

said flexible tubing connector extending into and partially through said flush port connector piece, said annular base portion in sealing engagement with the rib portion of said flush port connector; wherein, when fully assembled, the flush port connector can be freely rotated about said flexible tubing connector piece to facilitate attachment of the threaded end of said flush port connector piece to the flush port of an outboard boat motor.

* * * * *